US009234335B2

(12) United States Patent
Thomas et al.

(10) Patent No.: US 9,234,335 B2
(45) Date of Patent: Jan. 12, 2016

(54) TWO PIECE MOVEABLE HOSE RETRACTOR FOR A FAUCET

(75) Inventors: Kurt J. Thomas, Indianapolis, IN (US); Derek A. Brown, Lizton, IN (US); Brian A. Enlow, Fishers, IN (US)

(73) Assignee: Delta Faucet Company, Indianapolis, IN (US)

( * ) Notice: Subject to any disclaimer, the term of this patent is extended or adjusted under 35 U.S.C. 154(b) by 1293 days.

(21) Appl. No.: 12/277,047

(22) Filed: Nov. 24, 2008

(65) Prior Publication Data

US 2009/0145492 A1 Jun. 11, 2009

Related U.S. Application Data

(60) Provisional application No. 61/012,696, filed on Dec. 10, 2007.

(51) Int. Cl.
*E03C 1/04* (2006.01)

(52) U.S. Cl.
CPC ..... *E03C 1/04* (2013.01); *E03C 2001/0415* (2013.01); *Y10T 137/6943* (2015.04)

(58) Field of Classification Search
CPC ..... E03C 2001/0415; E03C 1/04; Y10T 137/6943
USPC ..... 137/355.25; 16/400, 403, 404, 2.1–2.5; 4/675–678, 420.4–420.5, 448, 615, 4/625, 401, 542; 482/110, 107, 82
See application file for complete search history.

(56) References Cited

U.S. PATENT DOCUMENTS

| | | | | |
|---|---|---|---|---|
| 2,608,409 | A | 8/1952 | Pinkerton | |
| 3,648,324 | A * | 3/1972 | Stradella et al. | 16/404 |
| 3,716,239 | A | 2/1973 | Goudreau | |
| 3,971,559 | A | 7/1976 | Diforte, Jr. | |
| 4,260,150 | A | 4/1981 | Tabet | |
| 4,360,159 | A * | 11/1982 | Haynes | 239/282 |
| 4,827,538 | A | 5/1989 | Heimann et al. | |
| 5,090,062 | A | 2/1992 | Hochstrasser | |
| 5,093,942 | A * | 3/1992 | Lang | 4/541.6 |
| 5,095,554 | A | 3/1992 | Gloor | |
| 5,311,909 | A | 5/1994 | Adcock | |
| 5,361,431 | A | 11/1994 | Freier et al. | |
| 5,460,378 | A * | 10/1995 | Getts | 473/251 |
| 5,575,424 | A | 11/1996 | Fleischmann | |
| 5,771,934 | A | 6/1998 | Warshawsky | |
| 5,931,755 | A * | 8/1999 | Mailey et al. | 474/161 |
| 5,960,832 | A | 10/1999 | Warshawsky | |
| 6,068,380 | A * | 5/2000 | Lynn et al. | 359/871 |
| 6,250,338 | B1 | 6/2001 | Dempsey | |
| 6,460,570 | B1 * | 10/2002 | Jones et al. | 137/801 |
| 6,757,921 | B2 | 7/2004 | Esche | |
| 6,807,691 | B1 * | 10/2004 | Hertz | 4/654 |
| 6,915,817 | B2 | 7/2005 | Benstead et al. | |
| 7,143,780 | B1 * | 12/2006 | Pitts | 137/382 |
| 7,191,475 | B1 * | 3/2007 | Marcotte | 4/567 |
| 2004/0010848 | A1 | 1/2004 | Esche | |
| 2004/0216789 | A1 | 11/2004 | Benstead et al. | |
| 2005/0279676 | A1 | 12/2005 | Izzy et al. | |

* cited by examiner

*Primary Examiner* — Arthur O Hall
*Assistant Examiner* — Chee-Chong Lee
(74) *Attorney, Agent, or Firm* — Faegre Baker Daniels LLP

(57) ABSTRACT

A hose retractor for use with a pull-out dispensing unit of a faucet.

18 Claims, 5 Drawing Sheets

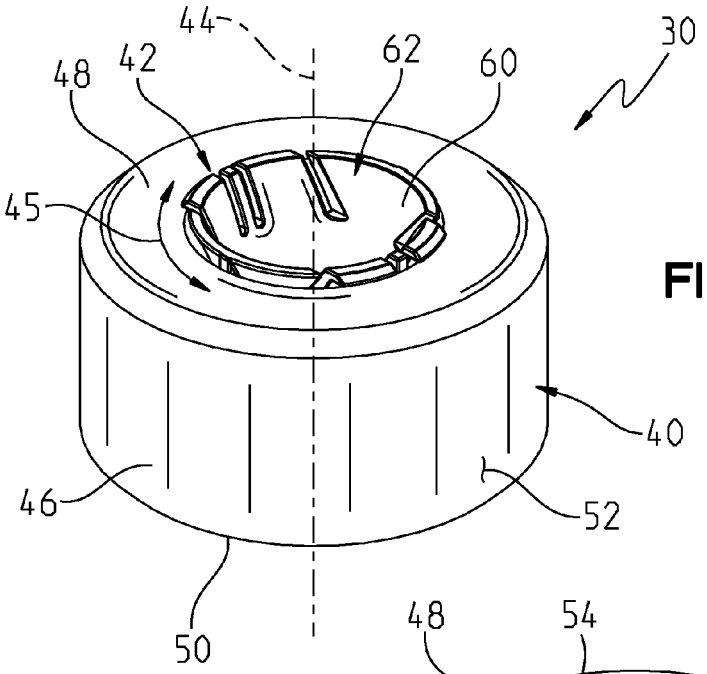
FIG. 3
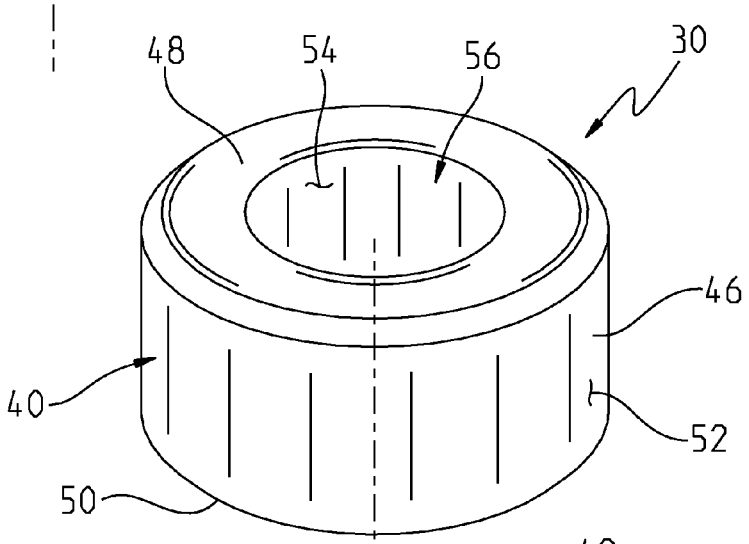
FIG. 4
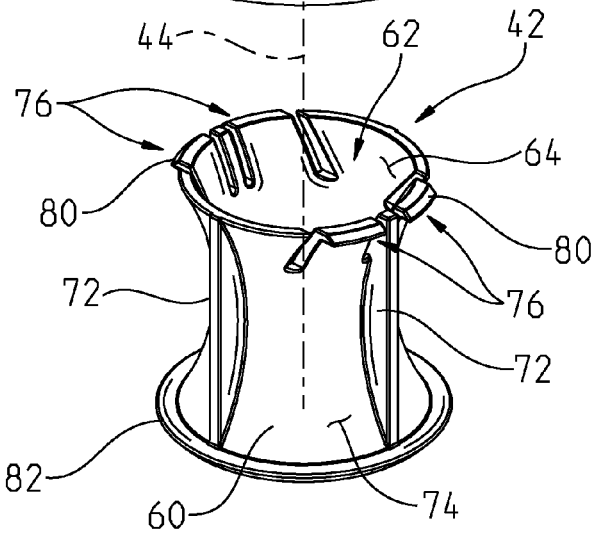

TWO PIECE MOVEABLE HOSE RETRACTOR FOR A FAUCET

CROSS-REFERENCE TO RELATED APPLICATION

This application claims priority to U.S. Provisional Application Ser. No. 61/012,696, filed Dec. 10, 2007, the disclosure of which is expressly incorporated by reference herein.

BACKGROUND AND SUMMARY OF THE INVENTION

Faucets including a pull-out dispensing unit, such as a spout spray head or a side spray, generally utilize a retractor, such as a weight or a spring, to help retract a hose back into a rest position after the dispensing unit has been removed from its docking station by the user. The hose typically extends below the mounting surface of the faucet behind the sink. More particularly, the hose travels from the faucet valve above the mounting surface, loops down and returns back above to attach to the dispensing unit.

If a weight is used as a hose retractor, it is generally attached to the hose using some sort of clamp. By clamping the weight to the hose, the effective length of the hose is shortened if the weight is placed on the portion of the hose past the loop (generally the bottom) closest to the spray head, or is ineffective over the final portion of the travel if placed before the loop (generally the bottom), closest to the valve. As an alternative, a sliding weight as a hose retractor provides a substantially constant force on the hose independent of dispensing unit position since the sliding weight is always located near the bottom of the loop due to gravity. Generally, the sliding weight is more efficient if the coefficient of friction between the hose and the weight is as small as possible and the mass of the weight is as great as possible. The contact surface of the weight generally should be corrosion resistant. Cost constraints on designs and material weight are often competing factors.

According to an illustrative embodiment of the present disclosure, a retractor for use with a faucet pull-out hose includes an outer portion formed of a first material, and an insert portion formed of a second material different from the first material. The insert portion is rotatably received within the outer portion and is configured to slidably receive the pull-out hose.

According to a further illustrative embodiment of the present disclosure, a retractor for use with a faucet pull-out hose includes an outer portion, and an insert portion concentrically received within the outer portion and configured to slidably receive the pull-out hose. A releasable coupler is supported by the insert portion and is configured to releasably couple the insert portion to the outer portion.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which:

FIG. 3 is a perspective view of the illustrative hose retractor of FIGS. 1 and 2;

FIG. 4 is an exploded perspective view of the hose retractor of FIG. 3;

DETAILED DESCRIPTION OF THE DRAWINGS

The embodiments of the invention described herein are not intended to be exhaustive or to limit the invention to precise forms disclosed. Rather, the embodiment selected for description have been chosen to enable one skilled in the art to practice the invention.

Figure 1:
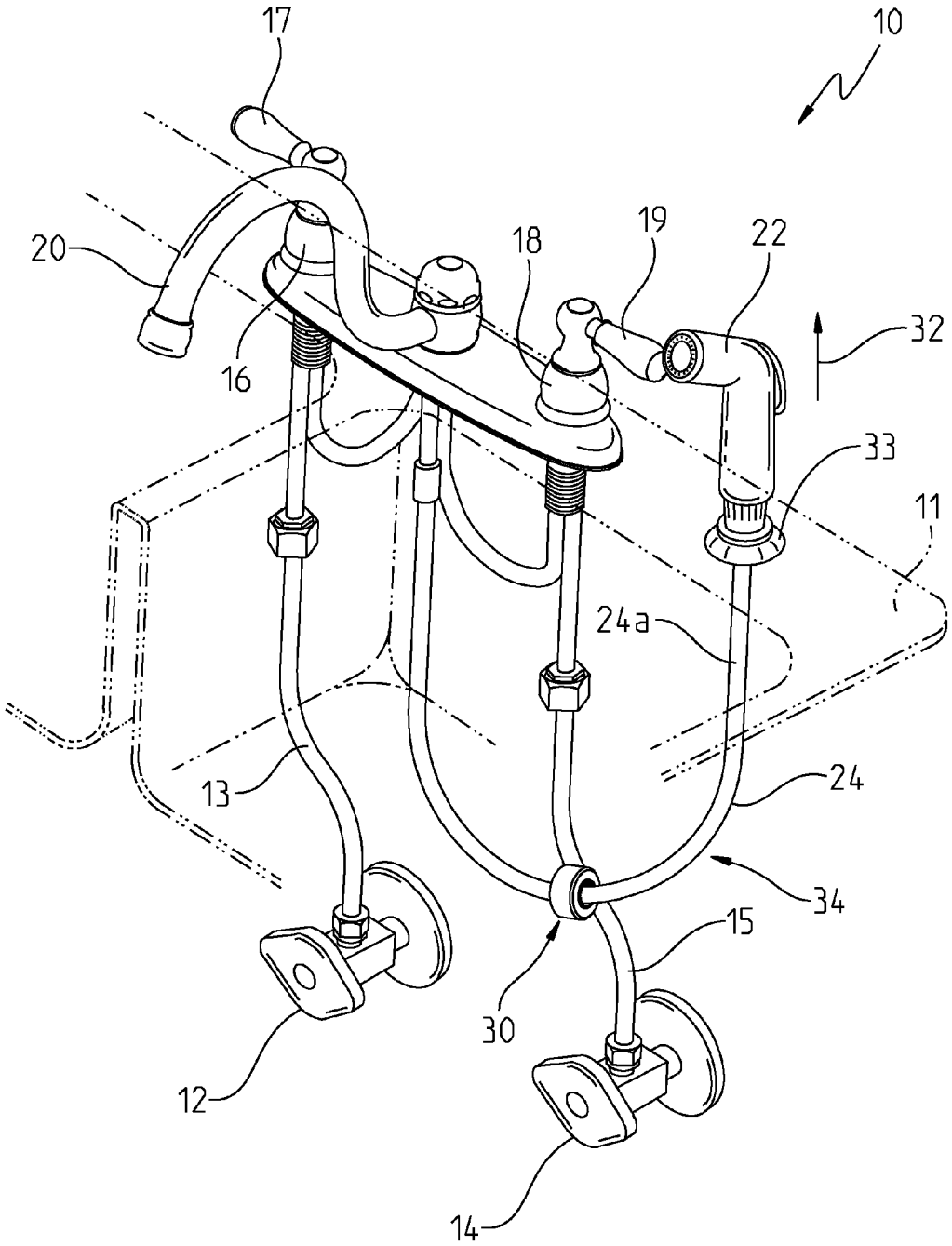
FIG. 1 is a perspective view of an illustrative faucet assembly mounted to a sink deck and including an illustrative hose retractor slidably mounted on a hose for a side sprayer releasably coupled to the sink deck.

Referring initially to FIG. 1, an illustrative faucet assembly 10 is shown mounted to a sink deck 11 and fluidly coupled to hot water and cold water supplies, illustratively conventional hot and cold water stops 12 and 14, through risers or supply lines 13 and 15, respectively. As is known, conventional hot and cold water control valves 16 and 18 are coupled to handles 17 and 19, respectively, and control the flow of water from the supply lines 13 and 15 to an outlet, typically either a delivery spout 20 or a dispensing unit, such as a side sprayer 22. A conventional diverter (not shown) may be utilized to toggle mixed water output to either the delivery spout 20 or the side sprayer 22. A flexible outlet conduit or hose 24 fluidly couples the side sprayer 22 to the control valves 16 and 18.

An illustrative retractor or hose weight 30 is slidably mounted on the hose 24 and is configured to help retract the hose 24 back into the rest position shown in FIG. 1 after the side sprayer 22 has been removed upwardly by the user away from the sink deck 11 (in the direction of arrow 32). In the embodiment of FIG. 1, the side sprayer 22 is in a rest position when releasably coupled to a docking station 33 supported by the sink deck 11. Due to gravity, the retractor 30 tends to rest at a lower portion of a loop 34 defined by the hose 24 when the side sprayer 22 is in the rest position.

Figure 2:
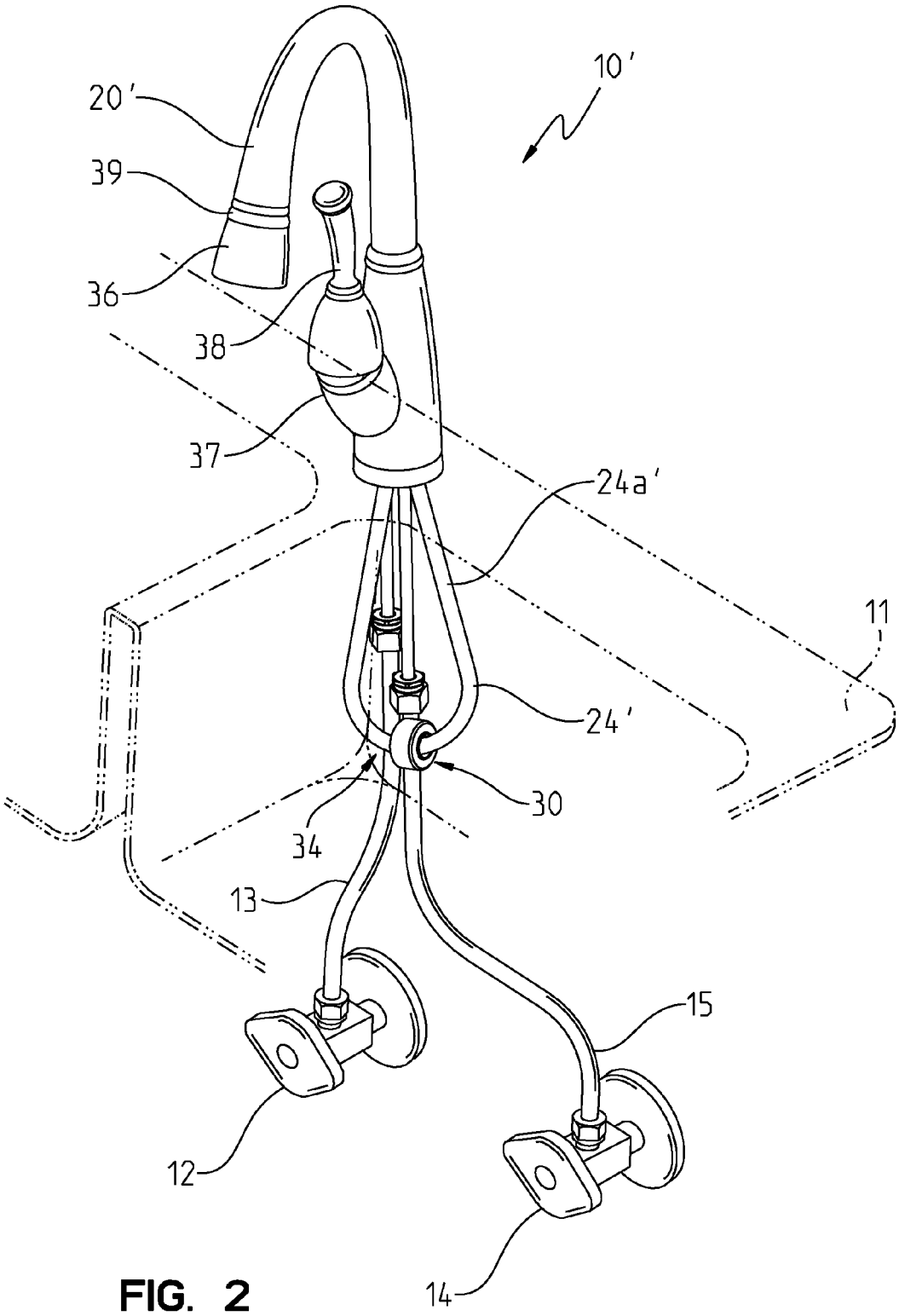
FIG. 2 is a perspective view similar to FIG. 1, showing a further illustrative faucet assembly mounted to the sink deck and including the illustrative hose retractor slidably mounted on a hose for a pull-out spray head releasably coupled to a delivery spout.
Figure 5:
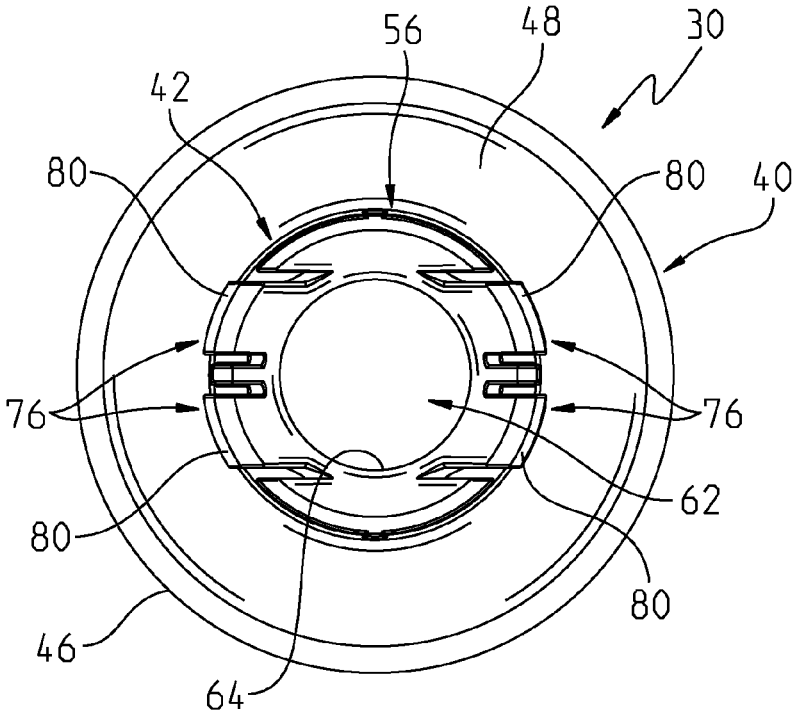
FIG. 5 is a top plan view of the hose retractor of FIG. 3.
Figure 6:
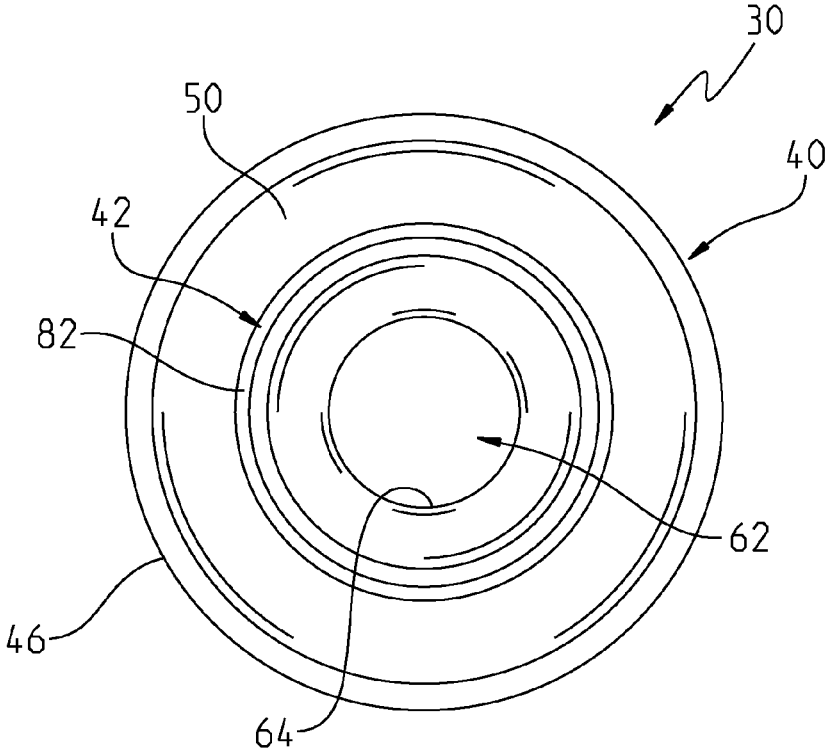
FIG. 6 is a bottom plan view of the hose retractor of FIG. 3.
Figure 7:
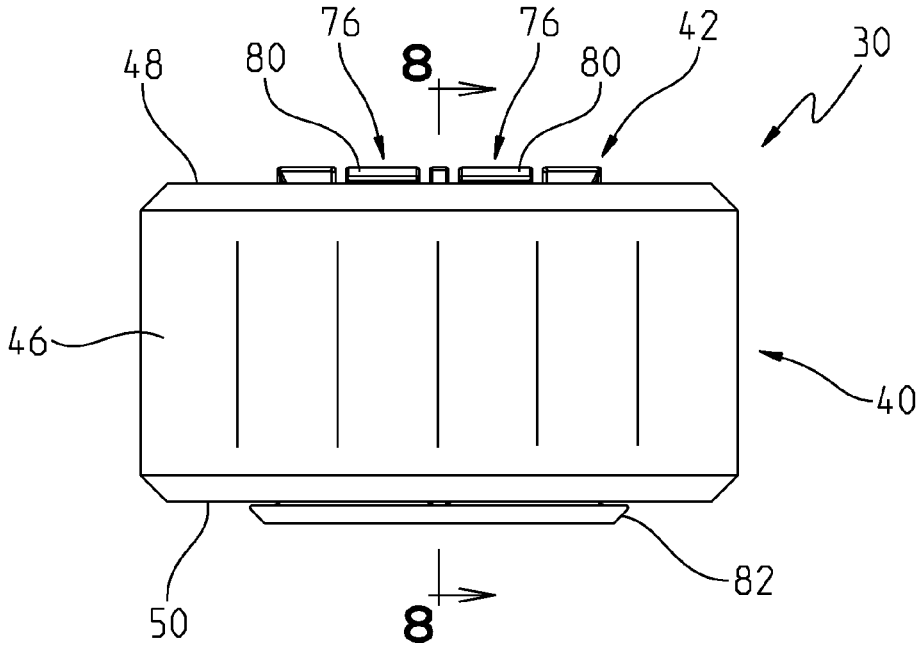
FIG. 7 is a side elevational view of the hose retractor of FIG. 3.

FIG. 2 illustrates a further illustrative faucet assembly 10' mounted to the sink deck 11. The faucet assembly 10' of FIG. 2 includes a dispensing unit, such as a pull-out spray head 36 releasably coupled to the delivery spout 20'. More particularly, the pull-out spray head 36 is fluidly coupled to a mixing valve 37 to receive mixed water outflow therefrom. As is known, the mixing valve 37 is coupled to a handle 38 and controls the flow of water from the supply lines 13 and 15 to the spray head 36. A flexible outlet conduit or hose 24' couples the mixing valve 37 to the pull-out spray head 36. As with the faucet assembly 10 of FIG. 1, the retractor 30 is slidably received on the outlet hose 24' and tends to rest at a lower portion of a loop 34' defined by the hose 24' when the sprayer is in the rest position. In the embodiment of FIG. 2, the pull-out spray head 36 is in a rest position when releasably coupled to a docking station 39 supported by the outlet of the delivery spout 20'.

In both FIGS. 1 and 2, the material dimensions and resulting weight of the retractor 30 are selected to assist in retracting the dispensing unit 22, 36, and connected hose 24, from a use position in spaced relation to the respective docking station 33, 39 to a rest position coupled to the docking station 33, 39. Illustratively, the retractor 30 has a weight greater than the weight of the dispensing unit 22, 36, and the weight of the portion 24*a*, 24*a*' of hose 24, 24' extending between the retractor 30 at the rest position and the dispensing unit 22, 36, including water contained therewithin. In one illustrative embodiment, the retractor 30 has a weight of approximately 1 lb. (approximately 0.454 kilogram)

The outlet hose 24, 24' may be constructed in any conventional manner, including use of a polymer. In one illustrative embodiment, the outlet hose 24, 24' comprises a cross-linked polyethylene (PEX). In still other illustrative embodiments, the outlet hose 24, 24' may comprise a polymer and/or composite liner surrounded by a covering (not shown), such as a protective sleeve or braiding. The protective sleeve may be formed of conventional materials, such as metal or polymeric fibers. Illustratively, the outlet hose 24, 24' has an outer diameter of approximately 0.48 inches (approximately 1.219 centimeters).

With further reference to FIGS. 3 and 4, the illustrative retractor 30 includes an outer portion 40 and an inner insert portion 42 supported for rotation relative to the outer portion 40. The retractor 30 is free to slide along the hose 24, 24' intermediate opposing ends thereof. The insert portion 42 is concentrically received within the outer portion 40 and is configured to rotate relative thereto about a common longitudinal axis 44 (see arrows 45 in FIG. 3). Illustratively, the outer portion 40 is formed of a relatively heavy material, such as steel or iron. In one illustrative embodiment, the outer portion 40 is formed of a mild steel having a density of about 0.283 lb. (about 0.128 kilogram/in$^3$). The material of the outer portion 40 may be treated in order to reduce the likelihood of corrosion. One illustrative type of treatment is a chromate plating or coating.

The outer portion 40 of the retractor 30 includes a cylindrical side wall 46 extending between opposing first and second faces 48 and 50. The cylindrical side wall 46 extends substantially parallel to the longitudinal axis 44, while the first and second faces 48 and 50 extend substantially perpendicularly inwardly from an outer surface 52 to an inner surface 54 of the side wall 46. An inner central opening 56 is defined by the inner surface 54 of the side wall 46. The opening 56 extends substantially parallel to the longitudinal axis 44 between the first and second faces 48 and 50 (FIG. 4).

The insert portion 42 is illustratively formed from a material having a relatively low coefficient of friction, thereby facilitating sliding movement of the retractor 30 relative to the hose 24, 24'. Illustratively, the insert portion 42 is formed from a polymer. In one illustrative embodiment, the insert portion 42 is molded from a thermoplastic, such as Celcon M90, an acetal polymer available from Ticona of Florence, Ky. The illustrative material of insert portion 42 has a coefficient of friction against steel of about 0.15 and a density of about 0.051 lb (about 0.0231 kilogram/in$^3$).

Figure 8:
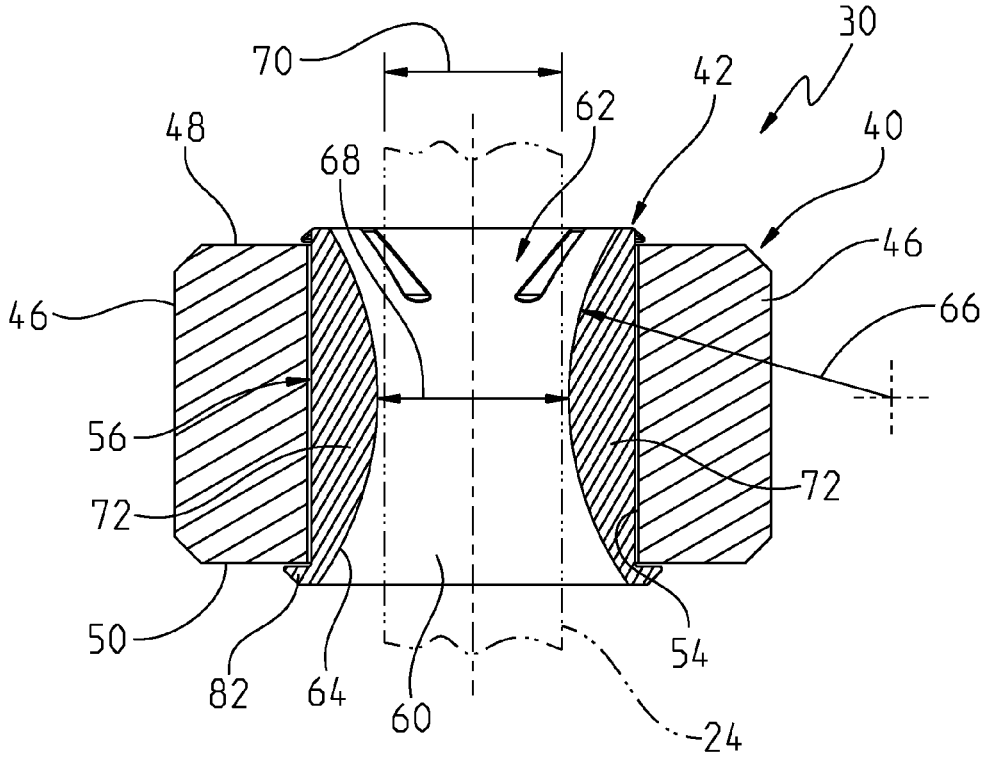
FIG. 8 is a cross-sectional view taken along line 8-8 of FIG. 7.

With reference to FIGS. 4-8, the insert portion 42 includes a side wall 60 having an hourglass shape and defining a hose passageway 62. More particularly, the insert portion 42 includes an inwardly curved inner surface 64 to assist in the sliding contact of the retractor 30 along the hose 24, 24'. The inner surface 64 of the side wall 60 has a radius of curvature 66 of approximately 1.2 inches (approximately 3.048 centimeters) as shown in FIG. 8. Furthermore, the passageway 62 defined by side wall 60 is configured to slidably receive the hose 24, 24' wherein the narrowest portion 68 of the passageway 62 is defined to be approximately 0.72 inches (approximately 1.829 centimeters). As noted above, the hose 24, 24' has an outer diameter 70 of approximately 0.48 inches (approximately 1.219 centimeters).

A plurality of strengthening ribs 72 extend longitudinally along an outside of the insert portion 42. More particularly, the strengthening ribs 72 extend longitudinally along an outside surface 74 of the side wall 60. In one illustrative embodiment, the strengthening ribs 72 are equally positioned at approximately 90 degree increments around the exterior of the side wall 60.

A plurality of resilient fingers 76 are positioned along a first or upper end 78 of the insert portion 42. Each finger 76 includes a locking lip or tab 80 configured to engage the first face 48 of the outer portion 40. An annular retaining lip or flange 82 is positioned at the second or lower end 84 of the insert portion 42. The flange 82 is configured to engage the second face 50 of the outer portion 40. During assembly, the insert portion 42 is passed from adjacent the second face 50 through the opening 56 of the outer portion 40, thereby compressing the fingers 76 inwardly within the opening 56. As the fingers 76 pass beyond the opening 56 at first face 48, the fingers 76 expand outwardly such that the tabs 80 engage an edge of the first face 48. The retaining flange 82 engages an edge of the second face 50 thereby preventing the insert portion 42 from passing completely through the central opening 56 of the outer portion 40. The insert portion 42 is thereby secured within the outer portion 40. More particularly, the tabs 80 of the retaining fingers 76 are retained by the first face 48 of the outer portion 40, while the retaining flange 82 is secured by the second face 50 of the outer portion 40.

Movement of the insert portion 42 relative to the outer portion 40 helps prevent the retractor 30 from catching and not freely moving along the hose 24, 24'. As such, the retractor 30 has increased flexibility, particularly when dealing with potential obstacles underneath the sink deck 11. Furthermore, the insert portion 42 being formed of a different material from the outer portion 40 improves the functionality of the retractor 30. The material of the insert portion 42 may be a relatively inexpensive thermoplastic. The low density of the insert portion 42 would make for an extremely large weight if the entire structure was formed thereof. Therefore, the outer portion 40 is attached to the insert portion 42 and is formed of a relatively inexpensive, dense or heavier material, in this case, mild steel. The outer portion 40 may be plated or coated for resistance to corrosion, and does not engage and potentially abrade the hose 24, 24' as does the insert portion 42.

The retractor 30 of the present disclosure is composed of multiple parts movable relative to each other which improve the function of the retractor 30, thereby facilitating free movement of the retractor 30 along the hose 24, 24', improving effectiveness.

In alternative embodiments, the insert portion 42 may be attached to the outer portion 40 by other means, such as an adhesive, pressing the insert portion 42 into the outer portion 40 through a dimensional interference, or by overmolding the insert portion 42 onto the outer portion 40.

Although the invention has been described in detail with reference to certain preferred embodiments, variations and modifications exist within the spirit and scope of the invention as described and defined in the following claims.

The invention claimed is:

1. A device comprising:

a faucet pull-out hose; and a refractor, the retractor comprising:

an outer portion formed of a first material;

an insert portion formed of a second material different from the first material, the insert portion concentrically received within the outer portion, the insert portion being rotatable relative to the outer portion along an axis common to the outer portion and the insert portion, and slidably receiving the faucet pull-out hose, the insert portion including an inner surface having an hourglass shape with a curvature extending in an axial direction and a curvature extending in a transverse direction to assist in axial and rotational movement of the insert portion relative to the faucet pull-out hose;

a releasable coupler supported by the insert portion and configured to releasably couple the insert portion to the outer portion; and wherein the outer portion includes a first face and a second face, and an opening extending longitudinally between the first face and the second face, the releasable coupler including a retaining lip configured to engage the first face of the outer portion, and a biased member configured to axially pass through the opening of the outer portion and engage the second face of the outer portion.

2. The device of claim 1, wherein the first material of the outer portion is heavier than the second material of the insert portion.

3. The device of claim 2, wherein the first material of the outer portion is a metal.

4. The device of claim 2, wherein the second material of the insert portion is a polymer.

5. The device of claim 1, wherein the second material of the insert portion has a lower coefficient of friction than the first material of the outer portion.

6. A device comprising:

a faucet pull-out hose, and a retractor for use with the faucet pull-out hose, the retractor comprising:

an outer portion formed of a first material, the outer portion including an inner central opening defining a longitudinal axis;

an insert portion formed of a second material different from the first material, the insert portion concentrically received within the inner central opening of the outer portion, the insert portion rotatable relative to the outer portion about the longitudinal axis, and including a hose passageway extending along the longitudinal axis and configured to slidably receive the faucet pull-out hose, the insert portion having a curvature extending in an axial direction and a curvature extending in a transverse direction to assist in axial and rotational movement of the insert portion relative to the faucet pull-out hose;

a releasable coupler supported by the insert portion and releasably coupling the insert portion to the outer portion, wherein the outer portion includes a first face and a second face, and the central opening extending longitudinally between the first face and the second face, wherein the insert portion includes a longitudinally extending side wall, the side wall extending between the first face and the second face of the outer portion, and having a curved inner surface for contacting the faucet pull-out hose;

a retaining lip supported by a first end of the side wall and engaging the first face of the outer portion; and wherein the releasable coupler includes a plurality of resilient fingers supported by a second end of the side wall, each resilient finger including a locking tab engaging the second face of the outer portion.

7. The device of claim 6, further comprising a plurality of longitudinally extending strengthening ribs coupled to the side wall of the insert portion.

8. A device comprising:

a faucet pull-out hose, and a retractor for use with the faucet pull-out hose, the retractor comprising:

an outer portion including an inner central opening defining a longitudinal axis;

an insert portion concentrically received within the inner central opening of the outer portion, the insert portion rotatable relative to the outer portion about the longitudinal axis, and including a hose passageway extending along the longitudinal axis and configured to slidably receive the faucet pull-out hose, the insert portion having a curvature extending in an axial direction and a curvature extending in a transverse direction to assist in axial and rotational movement of the insert portion relative to the faucet pull-out hose;

a releasable coupler supported by the insert portion and releasably coupling the insert portion to the outer portion;

wherein the outer portion includes a first face and a second face, and the central opening extending longitudinally between the first face and the second face;

wherein the insert portion includes:

a longitudinally extending side wall, the side wall extending between the first face and the second face of the outer portion, and having a curved inner surface for contacting the faucet pull-out hose;

a retaining lip supported by a first end of the side wall and engaging the first face of the outer portion; and wherein the releasable coupler includes a plurality of resilient fingers supported by a second end of the side wall, each resilient finger including a locking tab engaging the second face of the outer portion.

9. The device of claim 8, wherein the insert portion is rotatably received within the outer portion.

10. The device of claim 8, wherein the outer portion is formed of a first material, and the insert portion is formed of a second material different from the first material.

11. The device of claim 10, wherein the first material of the outer portion is a metal.

12. The device of claim 10, wherein the second material of the insert portion is a polymer.

13. The device of claim 10, wherein the second material of the insert portion has a lower coefficient of friction than the first material of the outer portion.

14. The device of claim 8, further comprising a plurality of longitudinally extending strengthening ribs coupled to the side wall of the insert portion.

15. A device comprising:

a faucet pull-out hose; and a hose weight including:

an outer portion including a first face, a second face, and an opening extending along a longitudinal axis between the first face and the second face, an insert portion concentrically received within the inner central opening of the outer portion, the insert portion rotatable relative to the outer portion about the longitudinal axis, and including a hose passageway extending along the longitudinal axis and slidably receiving the faucet pull-out hose, the insert portion having a curvature extending in an axial direction and a curvature extending in a transverse direction to assist in axial and rotational movement of the insert portion relative to the faucet pull-out hose, and a releasable coupler supported by the insert portion and configured to releasably couple the insert portion to the outer portion, the releasable coupler including a retaining lip engaging the first face of the outer portion, and an outwardly biased member configured to axially pass through the opening of the outer portion and including a locking tab engaging the second face of the outer portion.

16. The device of claim 15, wherein the insert portion is rotatably received within the outer portion.

17. The device of claim 15, wherein the outer portion is formed of a first material, and the insert portion is formed of a second material different from the first material.

18. A device comprising:

a faucet pull-out hose; and a hose weight including:

an outer portion including a first face, a second face, and an opening extending along a longitudinal axis between the first face and the second face, an insert portion concentrically received within the inner central opening of the outer portion, the insert portion rotatable relative to the outer portion about the longitudinal axis and, including a hose passageway extending along the longitudinal axis and slidably receiving the faucet pull-out hose, a releasable coupler supported by the insert portion and releasably coupling the insert portion to the outer portion, the insert portion having a curvature extending in an axial direction and a curvature extending in a transverse direction to assist in axial and rotational movement of the insert portion relative to the faucet pull-out hose, and a plurality of longitudinally extending strengthening ribs coupled to the insert portion and positioned between the faucet pull-out hose and the outer portion of the hose weight, the strengthening ribs including a straight outer edge and a convex inner edge.

* * * * *

UNITED STATES PATENT AND TRADEMARK OFFICE

CERTIFICATE OF CORRECTION

PATENT NO. : 9,234,335 B2
APPLICATION NO. : 12/277047
DATED : January 12, 2016
INVENTOR(S) : Kurt Judson Thomas et al.

It is certified that error appears in the above-identified patent and that said Letters Patent is hereby corrected as shown below:

Claims

In Claim 1, Column 4, line 63, should read:

--a retractor, the retractor comprising:--

Signed and Sealed this
Nineteenth Day of April, 2016

Michelle K. Lee

Michelle K. Lee
*Director of the United States Patent and Trademark Office*